United States Patent [19]

Ito et al.

[11] 4,000,942

[45] Jan. 4, 1977

[54] TRANSFER MEDIUM SEPARATING DEVICE

[75] Inventors: Yoshio Ito; Katuhiko Yamada; Tadayuki Kitajima, all of Yokohama; Koichi Miyamoto, Tokyo; Hiroo Kobayashi, Tokyo; Yoshikuni Tohyama, Tokyo, all of Japan

[73] Assignee: Canon Kabushiki Kaisha, Tokyo, Japan

[22] Filed: Dec. 23, 1975

[21] Appl. No.: 643,803

[30] Foreign Application Priority Data

Dec. 27, 1974 Japan ..... 50-4018

[52] U.S. Cl. ..... 355/3 R; 271/DIG. 2

[51] Int. Cl.[2] ..... G03G 15/22

[58] Field of Search ..... 355/3 R, 3 TR, 3 DR, 355/3 TE, 11; 271/80, 174, DIG. 2

[56] References Cited

UNITED STATES PATENTS

| | | | |
|---|---|---|---|
| 3,684,363 | 8/1972 | Ito et al. | 355/3 R |
| 3,923,298 | 12/1975 | Ishida | 271/DIG. 2 |
| 3,936,045 | 2/1976 | Ariyama | 271/174 |
| 3,955,889 | 5/1976 | Ishiguro et al. | 271/DIG. 2 |

*Primary Examiner*—L. T. Hix
*Assistant Examiner*—Kenneth C. Hutchison
*Attorney, Agent, or Firm*—Fitzpatrick, Cella, Harper & Scinto

[57] ABSTRACT

In an electrophotographic copying apparatus of the type in which a toner image is transferred from the surface of a photosensitive medium to a transfer medium, a transfer medium separating device comprises a rotatable separating roller disposed downstream of an image transfer station where a toner image is transferred from the surface of the photosensitive medium to the transfer medium, a transfer medium end guide belt disposed in contact with the peripheral surface of the rotatable separating roller for separating one end of the transfer medium from the surface of the photosensitive medium at the image transfer station and for guiding the transfer medium away from the photosensitive medium after the image transfer, and a rotatable pressure roller disposed in pressure contact with the rotatable separating roller for transporting the transfer medium while urging the same against the rotatable separating roller and for separating the transfer medium from the surface of the photosensitive medium.

5 Claims, 11 Drawing Figures

TRANSFER MEDIUM SEPARATING DEVICE

BACKGROUND OF THE INVENTION

1. Field of the Invention

This invention relates to a transfer medium separating device in an electrophotographic copying apparatus. More particularly, it relates to a transfer medium separating device in an electrophotographic copying apparatus for separating a transfer medium from a photosensitive drum to which the transfer medium is electrostatically attracted.

2. Description of the Prior Art

An electrophotographic copying apparatus generally comprises a rotatable photosensitive drum, and various means disposed around the photosensitive drum successively in the direction of rotation thereof, such as electrostatic latent image forming means, means for developing electrostatic latent images, means for transferring the developed images to transfer mediums, and means for cleaning the photosensitive drum. In such an electrophotographic copying apparatus, the transfer medium is urged into contact with the photosensitive drum as by a corona discharger or a transfer roller during image transfer, with so intense an electrostatic attraction that the transfer medium cannot readily be separated from the drum. This necessitates the provision of some means for separating the transfer medium from the photosensitive drum.

There has heretofore been devised a separating means utilizing vacuum suction or a method of injecting a stream of air along the surface of the drum against the leading edge of the transfer medium. In the former, the separating mechanism must be rotated or moved in synchronism with the transfer medium. The latter also requires indispensably a means for providing the synchronization with the transfer medium. In either case, the use of a compressor or a pump is further required and this increases the cost of the apparatus, and increases the noise level of the machine, and the possibility of developer on the drum and/or the transfer medium being scattered within the apparatus.

A construction has therefore been proposed which comprises a separating belt stretched from the upstream to the downstream of the transfer means, and a separating roller disposed just downstream of the transfer means so as to deflect the separating belt away from the photosensitive drum at an angle of contact within 180° So that the transfer medium transported between the photosensitive drum and the transfer means may be directed to the separating roller by the separating belt without one side edge portion of the transfer medium being brought into contact with the photosensitive drum. An example of such construction is shown in FIGS. 1 and 2 of the accompanying drawings.

In FIGS. 1 and 2, there is seen a photosensitive drum 1 having its peripheral surface formed by a photosensitive layer $1_1$, an image transfer charger 2, a set of transfer medium feed rollers 3, and a transfer medium guide 4 along which a transfer medium P may be fed to the photosensitive drum 1.

From the upstream of the image transfer charger 2, an endless separating belt 5 is stretched in contact with the photosensitive drum 1. Immediately downstream of the image transfer charger 2, there is provided a separating roller 6 rotatable at a velocity equal to or higher than the peripheral velocity V of the photosensitive drum 1, and the separator belt 5 is directed away from the photosensitive drum 1 at an angle of contact $\alpha$ (0° to 180°) so that the transfer medium P may be guided with a widthwise side edge portion thereof maintained out of contact with the photosensitive drum 1 from a position before the image transfer process; and, after having passed the image transfer charger, the transfer medium may be guided away from the photosensitive drum 1 with a predetermined tension, whereby the transfer medium may be separated from the photosensitive drum 1.

The separator belt 5 is located at a position corresponding to a width of about 5 to about 20 mm at one side edge of the transfer medium P.

Rollers 7 and 8 are for rotatively driving the separating belt 5 and a guide roller 9, connected to a spring 10 by hook means, serves to normally impart tension to the separating belt 5.

The separating roller 6 has its surface coated with rubber so as to ensure that the separating belt 5 can be moved therearound without slipping, and also to ensure that the transfer medium P interposed between the roller 6 and the separating belt 5 can be positively transported.

Designated by 11 is a belt for transporting the transfer medium P to a fixing station. A guide 12 is provided between the separator 6 and the belt 11. Numeral 13 denotes a blower for blowing air on the transfer medium P.

The transfer medium P, when fed to the photosensitive drum 1 via the feed rollers 3, 3 and through the guide 4, is brought into intimate contact with the photosensitive drum 1 by the image transfer charger 2 for a toner image to be transferred from the drum to the transfer medium. When this occurs, one side edge portion of the transfer medium P is forcibly retained out of engagement with the photosensitive drum 1 by the separating belt 5 intervening therebetween, and the transfer medium is transported along the underside of the belt 5 to the separating roller 6. The transfer medium is then directed along the separating roller 6 away from the photosensitive drum 1 at an angle of contact $\alpha$, so that the side edge portion of the transfer medium P is drawn apart from the photosensitive drum 1 as soon as it passes the image transfer position, and it is further separated from the photosensitive drum 1 as it advances. Thus, the separating action progressively propagates from the portion of the transfer medium adjacent to the separating belt toward the successive inner portions of the transfer medium, whereby the transfer medium is naturally and yet positively separated from the photosensitive drum 1.

After being so separated from the photosensitive drum 1, the transfer medium P droops onto the separating roller 6 and the friction between the transfer medium and the roller 6 acts to transport such transfer medium to the belt 11 via the guide 12.

In order to enhance such separating action, air is blown from the blower 13 against the transfer medium separated from the photosensitive drum 1. The air should preferably be blown in a direction along the wedge-shaped space between the photosensitive drum 1 and the transfer medium P separated therefrom. If the shown direction of air flow is adopted, the air will naturally be sent along the upper surface of the transfer medium into the above-mentioned space to thereby promote the separation and also urge the transfer medium P against the guide 12 and the belt 11 to prevent it from floating up, thus ensuring intimate contact of the transfer medium with the belt 11 which results in positive transport thereof.

As will be seen from this example, the separation system using a separating belt has very excellent features as compared with the other methods already described. More particularly, it eliminates any special drive source for the separation, and accordingly the need to use a synchronizing means for providing synchronization. Moreover, the separating action constantly occurs in the separating station to ensure positive separation of transfer medium from the drum.

The operation of the separating belt 5 may be divided into two actions, namely, the action of drawing a leading edge corner $P_1$ of the transfer medium P from the photosensitive medium 1 at a point A (FIG. 3) to thereby provide a moment of separation, and the action of cooperating with the separating roller 6 to nip, draw up and transport the drawn-apart end of the transfer medium between points B and C to thereby propagate said moment throughout the entire width of the transfer medium.

Assuming that the surface of the photosensitive drum 1 and the surface of the separating roller 6 are spaced apart from each other by a distance *d*, the separating belt 5 is stretched over a common tangent AB (distance *l*) with the photosensitive drum 1 and the separating roller 6.

On the other hand, the transfer medium P is electrostatically attracted to and moved with the surface of the photosensitive drum 1. Even if the leading end edge of the transfer medium has passed the point A and one side corner $P_1$ thereof has been drawn apart from the photosensitive drum 1 by the separating belt 5, the remainder of the transfer medium tries to move forward along the surface of the drum 1 while being attracted thereto. Thus, the corner $P_1$ of the transfer medium is pulled on in the direction of arrow *f* by the remainder of the transfer medium which remains attracted to the drum 1, as illustrated in FIG. 4. Between the points A and B, however, the transfer medium P simply bears against the separating belt 5 and is not restrained from the movement in the direction perpendicular to the direction of travel. Consequently, the corner $P_1$ cannot resist the pull force *f*, with a result that some deviation of the corner $P_1$ arises in the direction perpendicular to the direction of travel. Such deviation increases with the distance from the point A and if the corner $P_1$ is disengaged from the separating belt 5, separation of the transfer medium will no longer be possible. Therefore, before it is disengaged from the separating belt, the corner $P_1$ must reach the point B whereat it can resist the pull force *f*. The increasing deviation may also hamper the subsequent separating action and cause oblique movement of the transfer medium P, and such increase in deviation must be avoided.

This in turn requires the distance *l* between A and B to be minimized, but it is not allowable to make such distance zero, that is, to bring the photosensitive drum 1 and the separating roller 6 into contact, because the contact therebetween would cause the developer on the photosensitive drum 1 to adhere to the separating roller 6 and contaminate the back side of the transfer medium P. Therefore, minimization of *d* and *l* to such an extent that no adhesion of the developer to the separating roller occurs is requisite for good separation by the system now under discussion.

Subsequently, the corner $P_1$ of the transfer medium P passes the point B and is nipped between the separating belt 5 and the separating roller 6, whereby it is subjected to an upward draw. This upward draw occurring between B and C is more abrupt than between A and B, so that the pull force *f* becomes stronger. By causing the upward draw to continue against the pull force *f*, the electrostatic attraction between the transfer medium P and the photosensitive drum 1 may be overcome to permit the separating action to propagate throughout the width of the transfer medium P.

It is the friction force between the separating roller 6 and the transfer medium P that restrains, against the pull force *f*, the corner $P_1$ of the transfer medium P from movement in the direction perpendicular to the direction of travel. The separating belt 5, however, is usually formed by a film of PETP or like material which is low in friction coefficient, and a high friction force between it and the transfer medium P cannot be expected. What creates a friction force between the transfer medium P and the separating roller 6 is the force with which the separating belt 5 urges the transfer medium against the separating roller 6, namely, the tension of the separating belt and the angle of contact $\alpha$ between the separating belt and the separating roller. In order to provide a friction force which will be sufficient to resist the pull force *f*, it is therefore necessary to cover the surface of the separating roller 6 with rubber of high friction coefficient, to provide a great angle of contact $\alpha$ and to provide a great tension of the separating belt 5. Nevertheless, the angle of contact $\alpha$ is limited by the construction of the copying machine and cannot be greater than a certain degree. Also, the separating belt 5 which is formed by a thin film of high molecular material should not have imparted thereto a tension exceeding a certain limit, otherwise the useful life of the belt will be decreased. Because of these practical limitations, the conventional separation system utilizing a separating belt has necessitated delicate conditioning for the separation effected only by the separating belt, and often involved the use of auxiliary means like the aforementioned air flow which is blown against the transfer medium at the separating station. This has unavoidably caused other problems in that some of the developer is scattered within the machine. In addition, the tension imparted to the separating belt is set at the allowable maximum and this is not sufficiently satisfactory in respect of the service life of the belt.

SUMMARY OF THE INVENTION

It is therefore an object of the present invention to provide a separation system which avails of the features of the above-described separating belt system and yet overcomes the above-noted problems.

According to the present invention, the transfer medium separating device, in an electrophotographic copying apparatus of the type in which a toner image is transferred from the surface of a photosensitive medium to a transfer medium, comprises a rotatable separating member disposed at a position downstream of an image transfer station, a transfer medium end guide member disposed in contact with the peripheral surface of the rotatable separating member for separating one end of of the transfer medium from the surface of the photosensitive medium at the image transfer station where a toner image is transferred from the surface of the photosensitive medium to the transfer medium and for guiding the transfer medium away from the photosensitive medium after the image transfer, and a rotatable pressure member disposed in pressure contact with the rotatable separating member for transporting the transfer medium while urging the same against said rotatable separating member and for separating the transfer medium from the surface of the photosensitive medium.

The rotatable pressure member may be formed with a groove so that it bridges over the end guide member and makes pressure contact with the rotatable separating member on both sides of the transfer medium end guide member.

The transfer medium end guide member disposed in contact with the rotatable separating member and the pressure member disposed in pressure contact with the rotatable separating member do not overlap each other on the peripheral surface of the rotatable separating member.

The invention will become more fully apparent from the following detailed description of some embodiments thereof taken in conjunction with the accompanying drawings.

DESCRIPTION OF THE PREFERRED EMBODIMENTS

Figure 1:
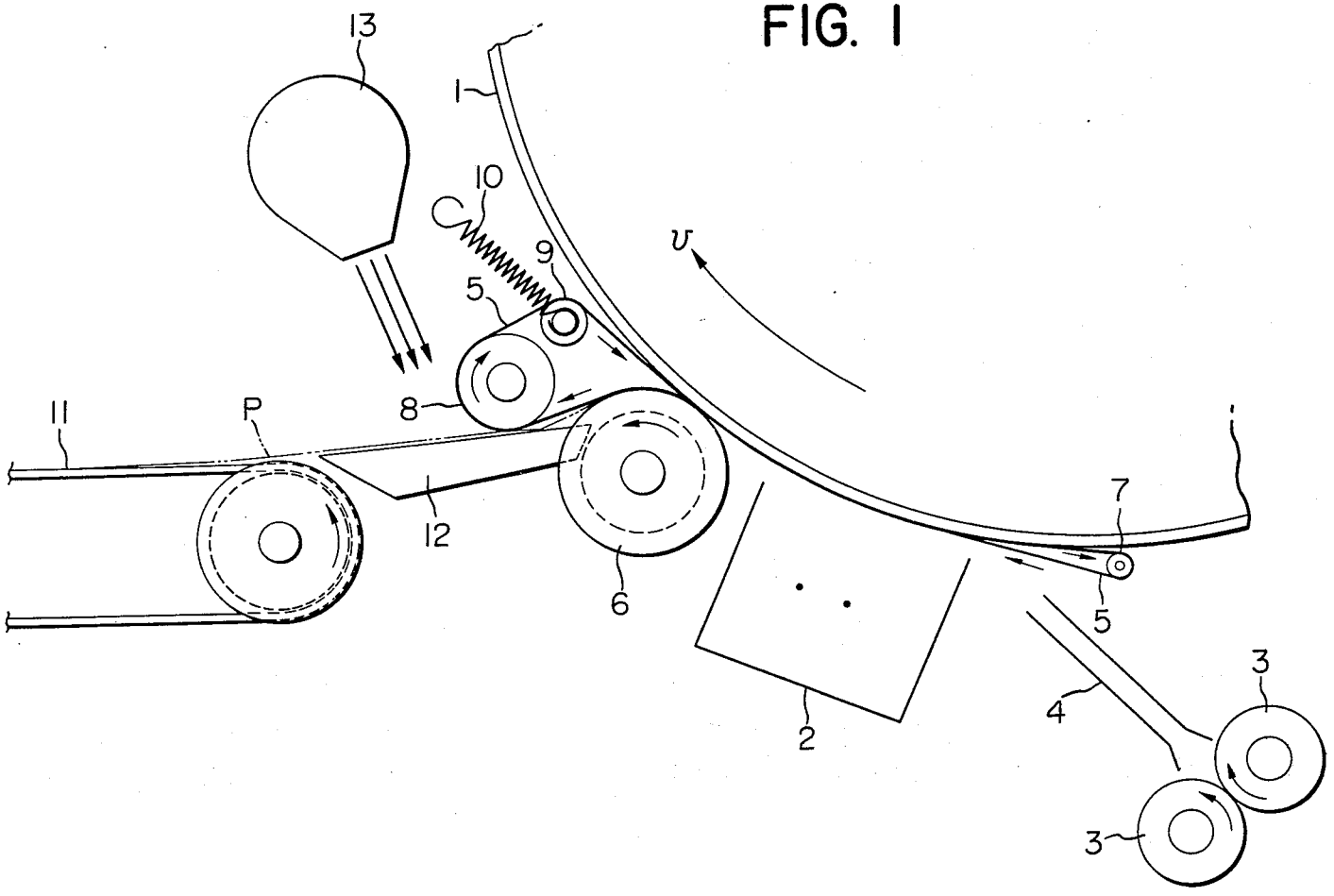
FIGS. 1 and 2 are a cross-sectional view and a perspective view, respectively, of the separating device using a separating belt.
Figure 2:
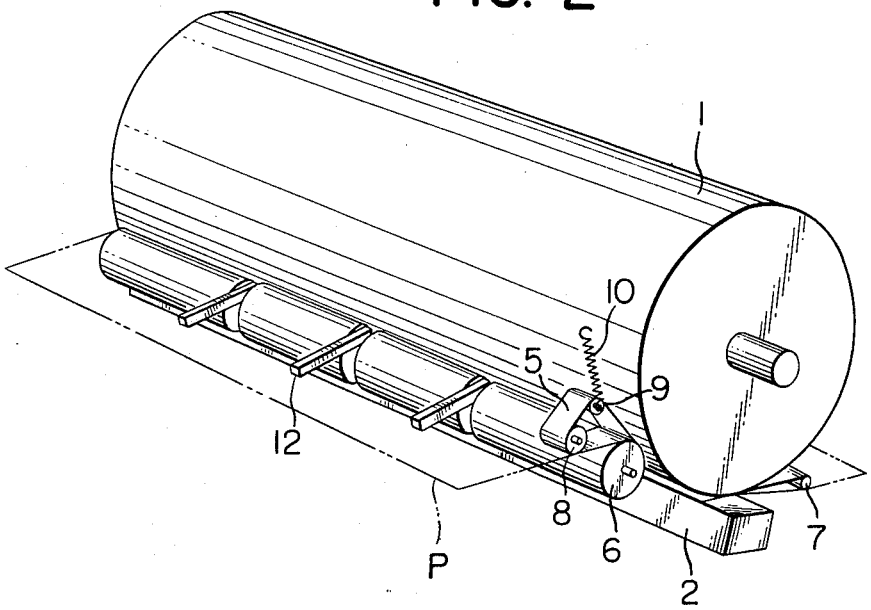
Figure 3:
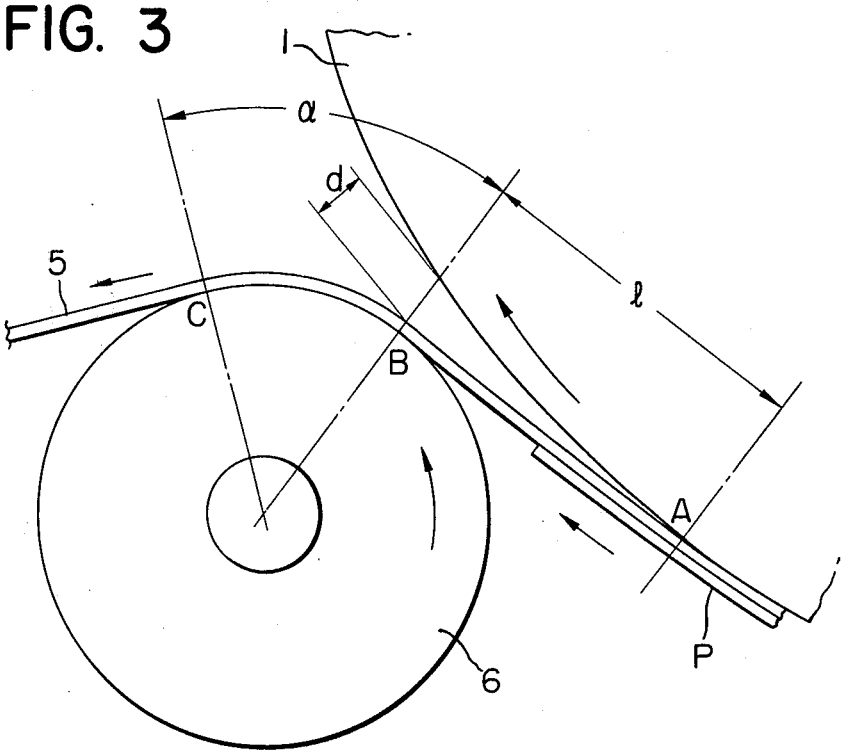
FIGS. 3 and 4 are a cross-sectional view and a perspective view, respectively, for illustrating the separating action provided by the separating belt.
Figure 4:
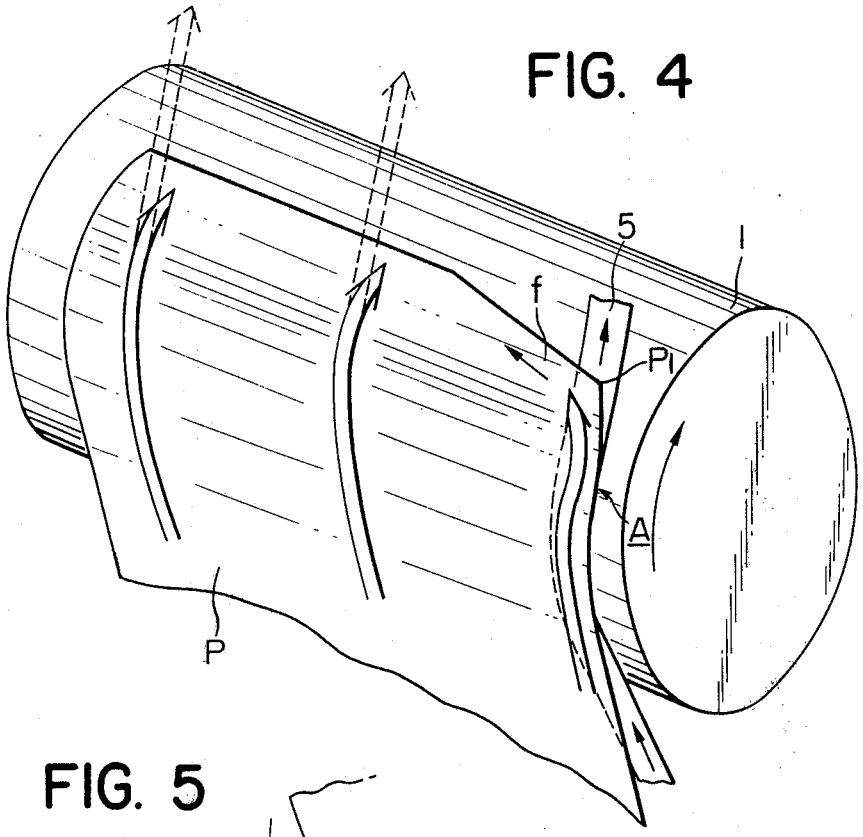
Figure 5:
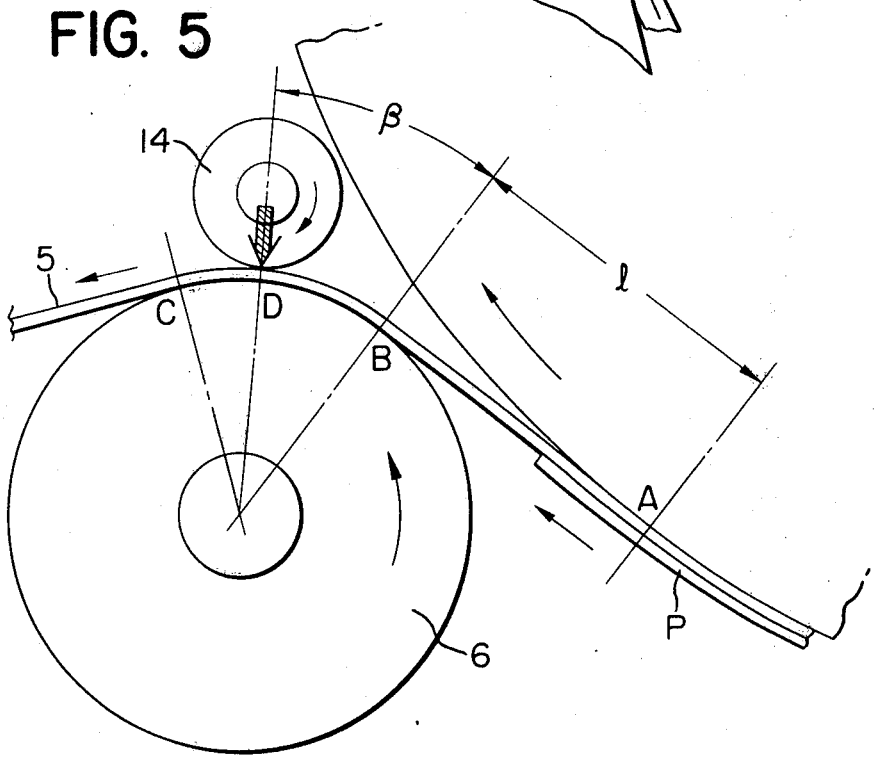
FIGS. 5 to 11 are cross-sectional views illustrating some embodiments of the separating device according to the present invention.
Figure 6:
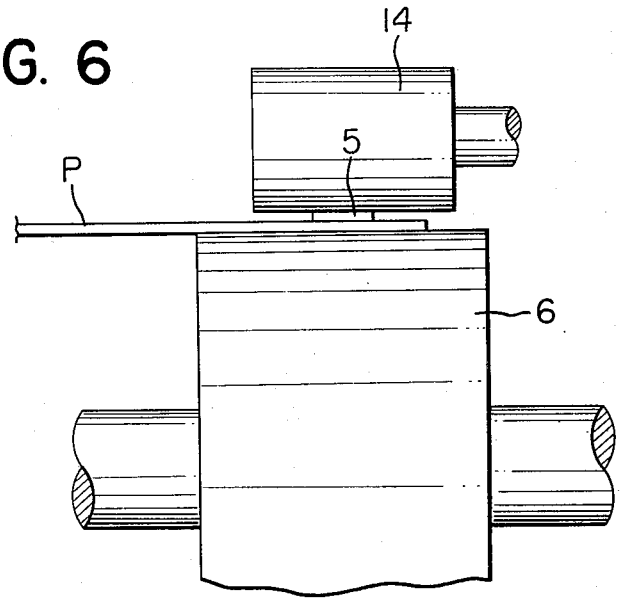

Referring to FIG. 5, there is shown an embodiment of the present invention. The separating device of the present invention is characterized in that the transfer medium P is transported by an end portion thereof drawn up by a separating belt 5 being nipped between a separating roller 6 and a pressure roller 14 driven by the roller 6. The pressure roller 14 is urged against the separating roller 6 as by a spring to transport the transfer medium with one side edge thereof nipped between the two rollers. To ensure the transport of the transfer medium P, the separating roller 6 and the pressure roller 14 may be coupled together as by a gearing which will assure rotation of the pressure roller 14. With such arrangement, the force with which the transfer medium P is urged against the separating roller 6 may be selected to any desired magnitude by the pressure roller 14, independently of the strength and the angle of contact of the separating belt 5. If the pressure roller 14 is coated with rubber or like material, the friction force between the pressure roller 14 and the transfer medium P will be increased to enable the transfer medium P to be restrained more strongly against the pull force $f$. This will eliminate the use of the pressure force provided by the separating belt 5 between B and C, thus permitting a greatly reduced tension of the separation belt 5. In such a case, the restraint between B and D becomes correspondingly smaller and it is thus recommendable that the distance between B and D (angle $\beta$) be as small as possible, that is, the point D be as close to the point B as possible within such a range that the pressure roller 14 does not contact the photosensitive drum 1. To that end, what is important is not only the arrangement but also the diameter of the pressure roller 14 which may be reduced to reduce $\beta$ or the diameter of the separating roller which may be reduced to reduce the distance between B and D even if $\beta$ remains unchanged.

The relation between the contact portion of the separating roller 6 with the pressure roller 14 and the separating belt 5 will now be considered. The separating effect as noted above may likewise be provided even if the roller 14 is urged against the roller 6 with the separating belt 5 nipped therebetween. However, the contact pressure of the pressure roller 14 against the separating roller 6 is considerably great because of the small area of contact and repeated passage between such rollers of the separating belt 5 which comprises a thin film as already described results in fatigue and shorter life of the belt, as is known from experiments.

Figure 7:
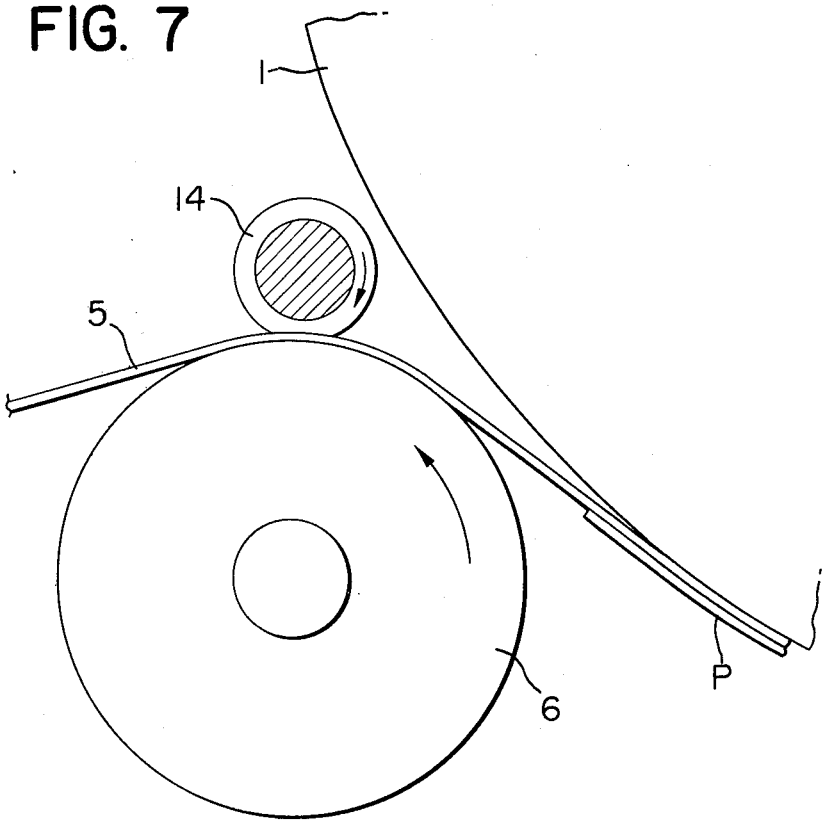
Figure 8:
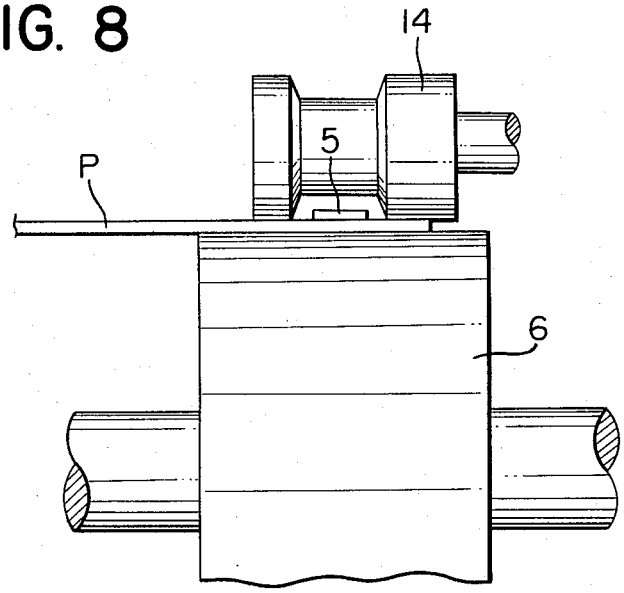
Figure 9:
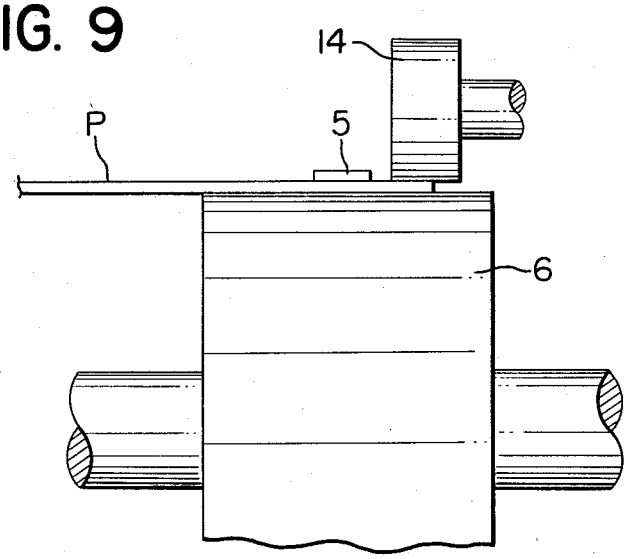
Figure 10:
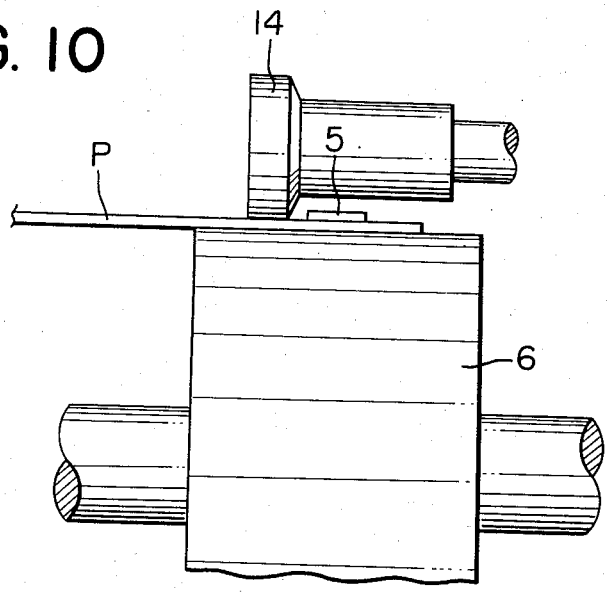

In order to prevent such shortening of the life of the separating belt, the pressure roller 14 according to the present invention is so configured that the separating belt 5 is not be nipped between the pressure roller and the separating roller 6. The configuration is shown in FIGS. 7 and 8, wherein the pressure roller 14 has its intermediate portion reduced in diameter so as to bridge over the separating belt 5 while only the opposite end portions of the roller 14 are urged against the separating roller 6. Thus, gpood separation by the pressure contact between the two rollers as described may be realized without adversely affecting the separating belt 5. Prevention of the separating belt 5 from being nipped may be achieved not only by the above-described bridging design of the pressure roller 14 but also by designing the pressure roller 14 as shown in FIGS. 9 and 10, whereby only one end portion of the pressure roller 14 is urged against the roller 6 without the separating belt 5 being nipped therebetween.

Figure 11:
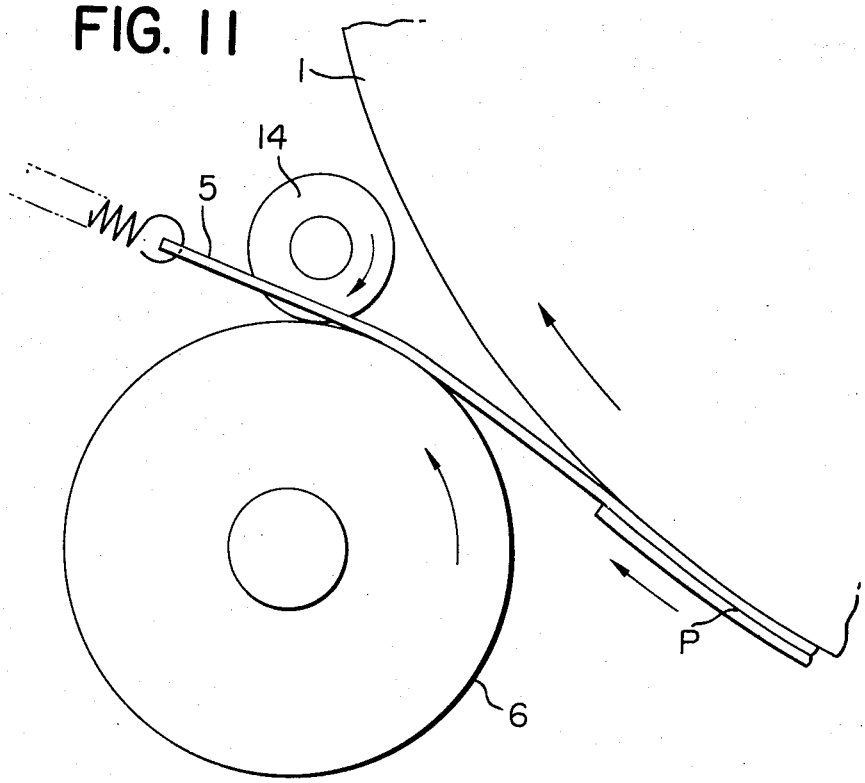

Also, such a design that the separating belt 5 is not nipped between the pressure roller 14 and the separating roller 6 eliminates the thrust force of the separating belt 5 which would otherwise be produced, and this in turn makes it feasible to fixedly dispose the separating belt 5 in the manner as shown in FIG. 11. Again in this case, it will be apparent that the same separating effect may be obtained as that obtained by the described system using a movable endless belt with transfer medium P.

By adoption of the above-described construction, the restraint imparted by the pressure roller 14 in the direction perpendicular to the direction of travel of the transfer medium P may be selected to any desired great magnitude so that the moment of separation can be spread over the entire width of the transfer medium P, thus eliminating the need for the auxiliary separating means such as blower 13 or the like which was required in the prior art. Thus, the structure of present invention is not accompanied by the problem of scattered developer and is less expensive and simpler.

Moreover, the present invention permits a reduced tension of the separating belt 5 and can accordingly improve the service life thereof to a great extent.

Further, in the separating station, the transfer medium P is transported by being firmly sandwiched and this ensures that the transfer medium P is positively and correctly directed to the subsequent process.

According to the present invention, as has hitherto been described, the separating roller 6 is positioned as close to the photosensitive drum 1 as possible and the pressure roller 14 as close to the separation starting position (point A) as possible so as to shorten the free section from the separation starting point A to the intense restraining point D, whereby there is provided a separation system which avails itself of the advantages of the separating belt system and yet overcomes the various problems inherent to the prior art.

What is claimed is:

1. A transfer medium separating device in an electrophotographic copying apparatus of the type in which a toner image is transferred from the surface of a photosensitive medium to a transfer medium, said device comprising:

a rotatable separating member disposed at a position downstream of an image transfer station;

a transfer medium end guide member disposed in contact with the peripheral surface of said rotatable separating member for separating one end of the transfer medium from the surface of the photosensitive medium at the image transfer station where a toner image is transferred from the surface of the photosensitive medium to the transfer medium and for guiding the transfer medium away from the photosensitive medium after the image transfer; and a rotatable pressure member disposed in pressure contact with said rotatable separating member for transporting the transfer medium while urging the same against said rotatable separating member and for separating the transfer medium from the surface of the photosensitive medium.

2. A transfer medium separating device according to claim 1, wherein said rotatable pressure member is formed with a groove so that it makes pressure contact with said rotatable separating member in a bridged relationship with said transfer medium end guide member.

3. A transfer medium separating device according to claim 1, wherein said transfer medium end guide member disposed in contact with said rotatable separating member and said pressure member disposed in pressure contact with said rotatable separating member are spaced from each other on the peripheral surface of said rotatable separating member.

4. A transfer separator device according to claim 1, wherein the position of said pressure contact between said rotatable pressure member and said rotatable separating member is in the vicinity of the point at which the transfer medium separates from the photosensitive medium.

5. A transfer medium separating device in an electrophotographic copying apparatus of the type in which a toner image is transferred from the surface of a photosensitive medium to a transfer medium, said device comprising:

a rotatable separating member disposed at a position downstream of an image transfer station;

a movable transfer medium end guide member disposed in contact with the peripheral surface of said rotatable separating member for separating one end of the transfer medium from the surface of the photosensitive medium at the image transfer station where a toner image is transferred from the surface of the photosensitive medium to the transfer medium and for guiding the transfer medium away from the photosensitive medium after the image transfer; and a rotatable pressure member disposed in pressure contact with said transfer medium end guide for movement therewith to urge said transfer medium end guide and the transfer medium against said rotatable separating member, for separating the transfer medium from the surface of the photosensitive medium, wherein the position of said pressure contact is in the vicinity of the point at which the transfer medium separates from said photosensitive medium.

* * * * *